United States Patent [19]

Marum

[11] 4,189,909

[45] Feb. 26, 1980

[54] INTEGRATED INJECTION LOGIC ELECTRONIC SYSTEM WITH VOLTAGE REGULATOR FOR MULTIPLEXED LIQUID CRYSTAL DISPLAY

[75] Inventor: Steven E. Marum, Sherman, Tex.

[73] Assignee: Texas Instruments Incorporated, Dallas, Tex.

[21] Appl. No.: 908,336

[22] Filed: May 22, 1978

[51] Int. Cl.[2] ..... G04C 5/00; G04B 19/30; G04B 17/00

[52] U.S. Cl. ..... 58/23 R; 58/50 R; 307/297; 340/765; 357/92

[58] Field of Search ..... 58/23 R, 50 R, 33; 307/296, 213, 303, 313, 297; 357/40, 44, 92; 340/765

[56] References Cited

U.S. PATENT DOCUMENTS

| | | | |
|---|---|---|---|
| 3,965,666 | 6/1976 | Williams | 58/23 BA |
| 4,007,385 | 2/1977 | Chapron | 307/296 |
| 4,013,901 | 3/1977 | Williams | 307/296 |

*Primary Examiner*—J. V. Truhe
*Assistant Examiner*—John B. Conklin
*Attorney, Agent, or Firm*—Melvin Sharp; James T. Comfort; N. Rhys Merrett

[57] ABSTRACT

An electronic system such as an electronic timepiece includes multi-level, integrated injection circuitry and a multiplexed liquid crystal display. A low-power voltage regulator is provided for driving the liquid crystal display and a current regulator is provided for driving the integrated injection logic circuitry. The current regulator is stacked between the logic levels in order to provide a fractional regulated voltage for driving the liquid crystal display without additional circuit elements and associated current drain.

10 Claims, 3 Drawing Figures

INTEGRATED INJECTION LOGIC ELECTRONIC SYSTEM WITH VOLTAGE REGULATOR FOR MULTIPLEXED LIQUID CRYSTAL DISPLAY

BACKGROUND OF THE INVENTION

This invention relates to integrated injection logic electronic systems with multiplexed liquid crystal displays, and more particularly, to such systems which incorporate a voltage regulator for providing a regulating voltage and fractional voltage to drive the display. The present application also discloses features of the voltage regulator that are disclosed and claimed in copending application Ser. No. 908,343 filed May 22, 1978 by Steven E. Marum and assigned to the Assignee of the present application.

Present-day electronic systems, such as calculators, timepieces, and the like, having multiplexed liquid crystal displays, require a regulated voltage $V_{CC}$ and a fractional voltage $V_{CC}/2$ for driving the backplane of the liquid crystal display with a multiplexing AC signal. In such prior art systems, a voltage regulator is provided having a series of diodes or resistors connected between the regulator and ground. A center-tap between the diodes or resistors provides the required fractional voltage $V_{CC}/2$, but consequently, requires a considerable amount of wasted current through the added diodes or resistors.

It is therefore an object of the present invention to provide an improved electronic integrated injection logic system with multiplexed liquid crystal display.

It is another object of the present invention to provide a system with low-power voltage regulator arrangement for driving a multiplexed liquid crystal display.

A further object of the invention is to provide a system with integrated injection logic circuitry and multiplexed liquid crystal display which is most efficiently powered by a single voltage regulator and current regulator.

It is yet another object of the invention to provide a low-power voltage regulator and current regulator arrangement for providing the required current and voltage levels for powering an integrated injection logic system and AC multiplexed liquid crystal display.

BRIEF DESCRIPTION OF THE INVENTION

These and other objects are accomplished in accordance with the present invention by providing an electronic system with series-connected multi-levels of integrated injection logic circuitry ($I^2L$) and a multiplexed liquid crystal display. A low-power consuming voltage regulator is provided for driving the liquid crystal display and a current regulator is provided for driving the integrated injection logic circuitry. The current regulator is stacked between the logic levels in order to provide a tapped regulated fractional voltage for driving the multiplexed liquid crystal display by utilizing the voltage drops across the logic levels.

BRIEF DESCRIPTION OF THE DRAWINGS

Still further objects and advantages of the invention will be apparent from the detailed description and claims when read in conjunction with the accompanying drawings wherein:

DETAILED DESCRIPTION OF PREFERRED EMBODIMENTS OF THE INVENTION

Figure 1:
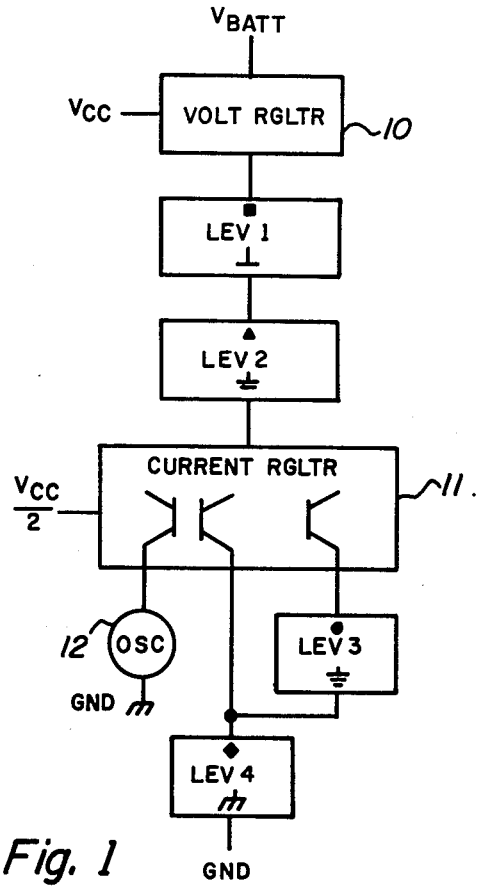
FIG. 1 is a block diagram of an electronic system in accordance with the present invention.

Referring now to the drawings, an electronic system, such as an electronic timepiece, utilizes series-connected, multi-level integrated injection logic circuitry for generating logic signals which are displayed by a liquid crystal display. The display is comprised of a liquid crystal material which does not require ultraviolet filtering, but which, consequently, has a negative temperature coefficient. One such material is comprised of 0.4 cholesteric and is commercially manufactured and sold by Roch Incorporated and identified as ROTN 132 material. The use of a stacked multi-level logic design for integrated injection logic systems, such as electronic watches, is described and claimed in U.S. Pat. No. 4,013,901, issued Mar. 22, 1977, to Clark R. Williams which patent is assigned to the assignee of the present invention and incorporated herein by reference. As described in said patent, a plurality of logic levels of integrated injection logic circuitry and a current regulator are connected in series between a battery power supply. The current regulator is also connected in series with an oscillator to regulate the oscillator current supply and thereby stabilize the oscillator frequency. This additional feature is described and claimed in U.S. Pat. No. 3,965,666, issued June 29, 1976, to Clark R. Williams, also assigned to the assignee of the present invention and incorporated herein by reference.

With reference to FIG. 1, two unique features are embodied in the present system when compared with the above-referenced circuit described in the earlier patents. Namely, current regulator 11 is herein positioned selectively between the logic levels thereby providing a regulated fractional voltage, namely $V_{CC}/2$, without requiring additional current-consuming circuitry, and a voltage regulator 10 has been added to the system in series with a plurality of the integrated injection logic levels to provide a regulated drive voltage for the multiplexed liquid crystal display with negative temperature coefficient, the logic levels acting as the electrical equivalent of regular diodes without additional power consumption.

Thus, in the present embodiment, four integrated injection logic levels (LEV 1–LEV 4) comprise an electronic logic system such as an electronic timepiece. Voltage regulator 10 is coupled to the battery voltage supply $V_{BATT}$ and provides the operating voltage $V_{CC}$ which is supplied to the first level LEV 1 of the logic circuit and the drive voltage to the LCD display as will later be described in detail. In addition, levels 1 and 2 appear to voltage regulator 10 as two series-connected diodes, and oscillator 12 appears to voltage regulator 10 as another two series-connected diodes to provide voltage regulation of the battery power supply with a negative temperature coefficient which matches the temperature coefficient of the display. More particularly, the above-referenced liquid crystal display has a negative temperature coefficient of −10 mv/°C. The regulated output voltage of regulator 10 is about 2.5 V with a temperature coefficient of about −10 mv/°C. which controls the display driver to approximately track the temperature coefficient of the liquid crystal display. The voltage may be raised to 3 volts and the temperature coefficient changed to −12 mv/°C. by adding an additional diode in series with $I^2L$ LEVEL 2 or oscillator 12 and the emitter of Q104.

Voltage regulator 10 and the voltage splitting arrangement provided by current regulator 11 embodied in the present electronic system, will now be described in further detail with respect to FIG. 2.

Figure 2:
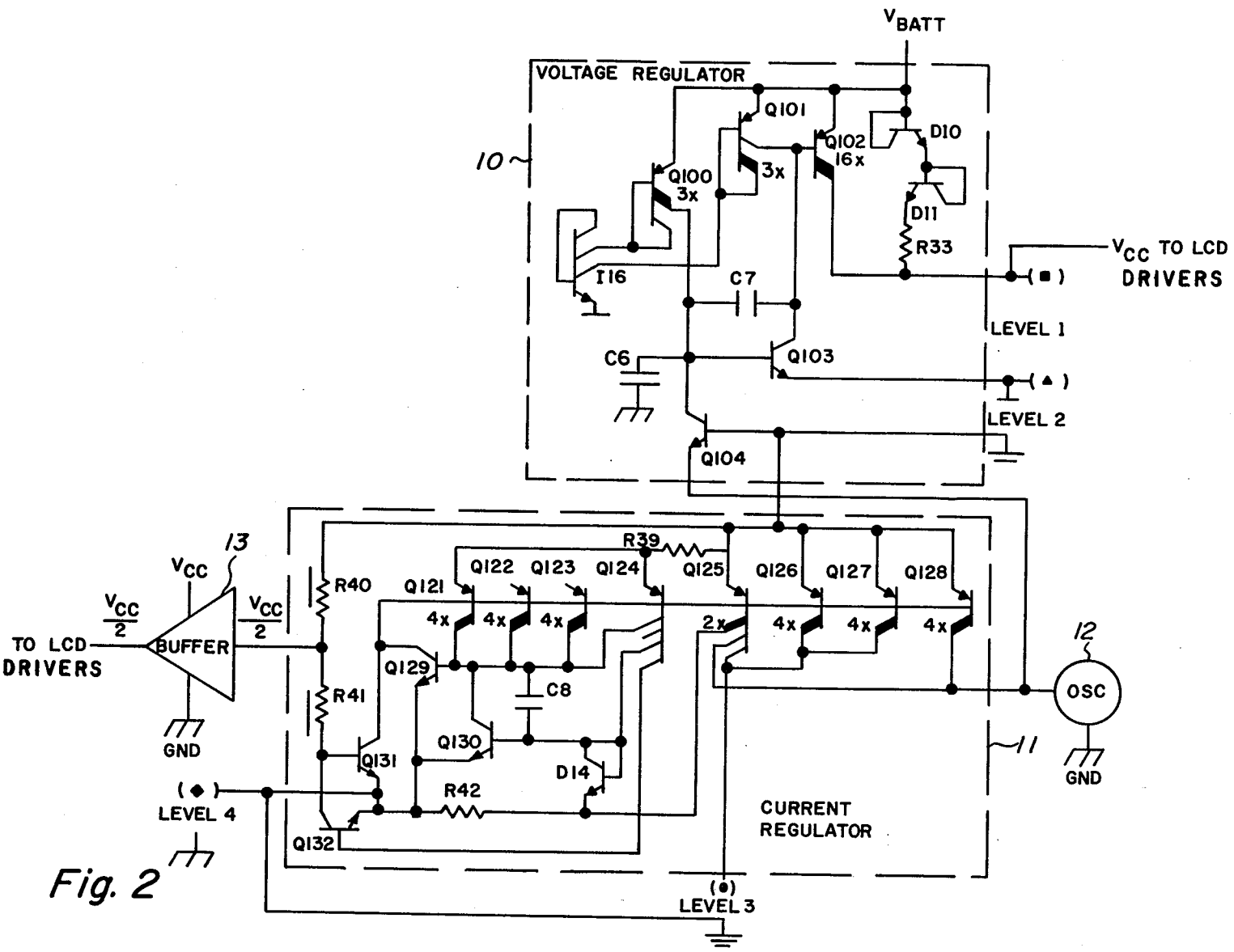
FIG. 2 is a circuit diagram of the voltage regulator and center-tapped current regulator which provide the required voltages for driving a negative temperature coefficient, multiplexed liquid crystal display.

Referring then to FIG. 2, voltage regulator 10 is comprised of a current sink provided by transistor I16, transistors Q100–Q104, start-up diodes D10 and D11, start-up resistor R33 and capacitors C6 and C7. Current regulator 11 is comprised of transistors Q121–Q132, diode D14, capacitor C8 and resistors R39–R42. It should be noted that the notations next to the transistor collectors of both regulators 10 and 11 (ie, 2×, 3×, 4×, etc) indicate the relative collector size. The emitters of transistors Q125–Q128 are the input and the collectors thereof are the outputs of current regulator 11; the emitter-collector voltage ($V_{EC}$) of transistors Q125 and Q128, which is the same as the base-emitter voltage ($V_{BE}$) of transistor Q104, is equal to the regulated voltage $V_{CC}$ applied to the anode of $I^2L$ LEVEL 1 minus the voltage drops across $I^2L$ LEVEL 1, $I^2L$ LEVEL 2 and oscillator 12. Transistor Q104 monitors this voltage ($V_{BE}$) and when its $V_{BE}$ exceeds about 0.5 volts, causes pass transistor Q102 to turn off. Transistor Q103 is the pre-driver transistor for transistor Q102. The emitter of transistor Q103 is coupled to the injector of $I^2L$ LEVEL 2 so that the pre-drive current is not wasted. Resistor R33 and diodes D10 and D11 provide start-up current into $I^2L$ LEVEL 1. Once LEVEL 1 starts up, current sink I16 causes transistors Q101 and Q100, as previously discussed, to turn on, and voltage regulator 10 begins running. Since, as previously discussed, $I^2L$ LEVEL 1 and $I^2L$ LEVEL 2 of the system are each the electrical equivalent of a diode with negative temperature coefficient, oscillator 12 of the system is the electrical equivalent of a plurality of two series-connected diodes with negative temperature coefficient and the base-emitter junction of transistor Q104 is the equivalent of a diode with negative temperature coefficient, the voltage output $V_{CC}$ from the collector of pass transistor Q102 is regulated by transistor Q103 according to the resultant negative temperature coefficient of the five equivalent diodes.

As previously discussed, in order to drive the multiplexed LCD display, utilized in conjunction with the system of the present invention, two voltages are required: $V_{CC}$ and $V_{CC}/2$. $V_{CC}$ is provided directly from the collector of transistor Q102 of voltage regulator 10 as previously described. A regulated voltage equal to $V_{CC}/2$ is generated in accordance with a novel feature of the present system without increased power consumption. This is accomplished by stacking two of the $I^2L$ logic levels (LEVEL 1 and LEVEL 2) above current regulator 11 and two levels (LEVEL 3 and LEVEL 4) below it. A startup pinch resistor comprised of resistors R40 and R41 is required to get current regulator 11 started when power is initially applied. Once regulator 11 starts, the startup resistor (R40 and R41) is shorted to a collector of regulator output transistor Q125 by transistor Q132 when saturated. Thus, by adding a center-tap to the startup resistor (ie, by providing two resistors R40 and R41, a voltage equal to $V_{CC}/2$ is obtained at the center-tap, without adding additional circuit elements which would increase power consumption. The $V_{CC}/2$ output voltage is buffered by means of buffer 13.

Figure 3:
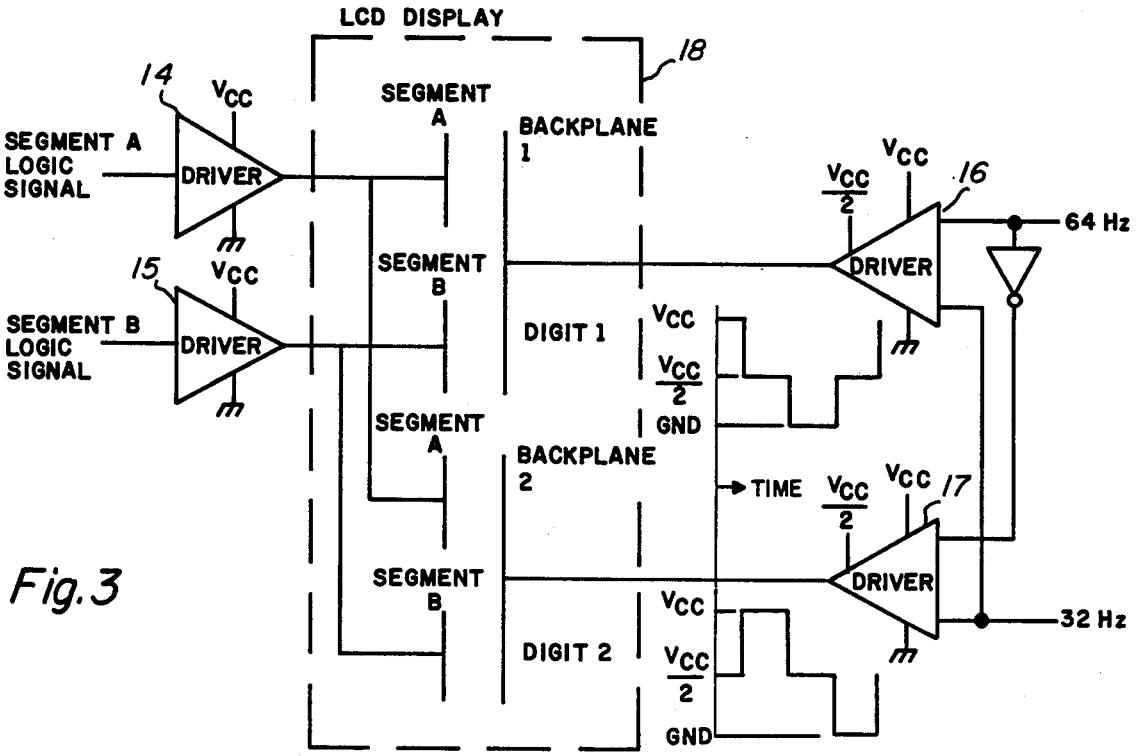
FIG. 3 is a circuit diagram of the multiplexed liquid crystal display.

Referring to FIG. 3, multiplexed LCD display 18, utilized in accordance with an embodiment of the system of the present invention, is illustrated. Display 18 includes a plurality of digits, each representing one or more alpha-numeric characters. Segment logic signals, A, B, etc, (eg, each character may have seven segments with each digit comprised of two characters) are simultaneously applied to a respective segment, SEGMENT A, SEGMENT B, etc. of each digit of the display by means of a respective segment driver, 14, 15, etc. A separate backplane (ie, BACKPLANE 1, BACKPLANE 2, etc) is provided for each respective digit (DIGIT 1, DIGIT 2, etc). The backplanes of the illustrated two-digit embodiment are driven by digit drivers 16 and 17, respectively. The backplanes are driven by means of a 32-HZ clock and a 64-HZ enable signal which alternately enables digit drivers 16 and 17 by means of NOT gate 19. The resulting backplane drive signals, which are applied to BACKPLANE 1 and BACKPLANE 2, are graphically illustrated as a function of time in FIG. 3. The backplane drive signals alternate between $V_{CC}$ and ground, alternately driving BACKPLANE 1 and BACKPLANE 2, thereby generating a visual display according to the selected segments forming the characters of DIGIT 1 and DIGIT 2.

Various embodiments of the present invention have now been described in detail. Since it is obvious that many additional changes and modifications can be made in the above-described details without departing from the nature and spirit of the invention, it is understood that the invention is not to be limited to said details except as set forth in the appended claims.

What is claimed is:

1. An $I^2L$ system comprised of:

(a) a current regulator coupled in series between first and second hierarchal levels of $I^2L$ circuitry to receive output current from said first of $I^2L$ circuitry and provide regulated current for said second level of $I^2L$ circuitry;

(b) a voltage regulator coupled in said series between the first level of $I^2L$ circuitry and a terminal for connection to a voltage source, said voltage regulator for producing a regulated voltage for driving a display, said current regulator including a center tap for producing a regulated fractional voltage for driving said display.

2. The $I^2L$ system according to claim 1 wherein said display is a multiplexed liquid crystal display.

3. The system according to claim 1 wherein said voltage regulator produces a voltage $V_{CC}$ and said center tap provides a voltage $C_{CC}/2$.

4. An $I^2L$ system comprised of:

(a) a first plurality of hierarchal levels of $I^2L$ circuitry connected in series;

(b) a second plurality of hierarchal levels of $I^2L$ circuitry connected in series;

(c) a voltage regulator for coupling said first plurality of levels of $I^2L$ circuitry to one terminal of a battery voltage supply;

(d) a current regulator coupled between said first and second pluralities of levels to receive output current from said first plurality of levels of $I^2L$ circuitry and for supplying regulated input current to said second plurality of levels of $I^2L$ circuitry; and (e) means for coupling said second plurality of levels of $I^2L$ circuitry of a second terminal of said battery voltage supply said voltage regulator for producing a regulated voltage $V_{CC}$ from a battery voltage $V_{BB}$ and said current regulator including a center tap for producing a fractional regulated voltage $V_{CC}/2$.

5. The system according to claim 4 wherein said current regulator includes a pair of series-connected, start-up resistors for starting said current regulator when power is initially applied including terminal means between said resistors to provide said center tap.

6. The system according to claim 4 including a multiplexed liquid crystal display means coupled between one of said levels of $I^2L$ circuitry and said voltage regulator for visually displaying display signals generated by said one level $I^2L$ circuitry.

7. The system according to claim 6 including a first plurality of driver means coupling said voltage regulator to said display means for driving said display means with an AC signal which alternates between $V_{CC}$ and ground.

8. The system according to claim 7 wherein said liquid crystal display means includes a plurality of backplanes and a corresponding plurality of groups of segments and wherein each of said first plurality of driver means couples a respective one of said backplanes to said regulated voltage $V_{CC}$, said fractional voltage $V_{CC}/2$ and ground, said first plurality of driver means being operable to apply said fractional voltage $V_{CC}/2$ and said AC signal alternately to said backplanes to thereby mutliplex said display means.

9. The system according to claim 8 including a second plurality of driver means each coupling a corresponding segment of each of said groups to said one level of $I^2L$ circuitry said second driver means for driving said display means with said display signal as said backplanes are multiplexed by said first plurality of driver means.

10. The system according to claim 4 wherein said system is an electronic timepiece.

* * * * *